United States Patent [19]

Lee

[11] 4,199,207

[45] Apr. 22, 1980

[54] CONVERTER PLUG WITH IMPROVED SELF-LOCKING TERMINALS TO STANDARD PLUG

[76] Inventor: Hop Lee, 2455-24th Ave., San Francisco, Calif. 94116

[21] Appl. No.: 948,952

[22] Filed: Oct. 5, 1978

[51] Int. Cl.[2] ..... H01R 3/06

[52] U.S. Cl. ..... 339/14 P; 339/75 P; 339/82; 339/136 R

[58] Field of Search ..... 339/14 P, 41, 39, 75 P, 339/82, 84, 85, 88 R, 89 M, 136 R

[56] References Cited

U.S. PATENT DOCUMENTS

| | | | |
|---|---|---|---|
| 2,829,358 | 4/1958 | Testori | 339/136 R X |
| 3,945,702 | 3/1976 | Poliak et al. | 339/88 R |
| 4,003,622 | 1/1977 | Gartland, Jr. | 339/88 R X |

*Primary Examiner*—Richard B. Lazarus
*Assistant Examiner*—DeWalden W. Jones
*Attorney, Agent, or Firm*—William R. Piper

[57] ABSTRACT

A converter plug with improved self-locking terminals that are adapted to interlock with the terminals on a standard electric plug when the prongs of the latter are inserted into openings in the converter plug and the standard plug is rotated through an angle with respect to the converter plug for causing its prongs to interlock with the converter plug. Novel means is provided in the converter plug to prevent the displacement of the electrodes therein when the electrodes on the standard plug are inserted into openings in the converter plug and the standard plug is rotated with respect to the converter plug for causing its terminals to interlock with the terminals in the converter plug.

1 Claim, 10 Drawing Figures

FIG-7-
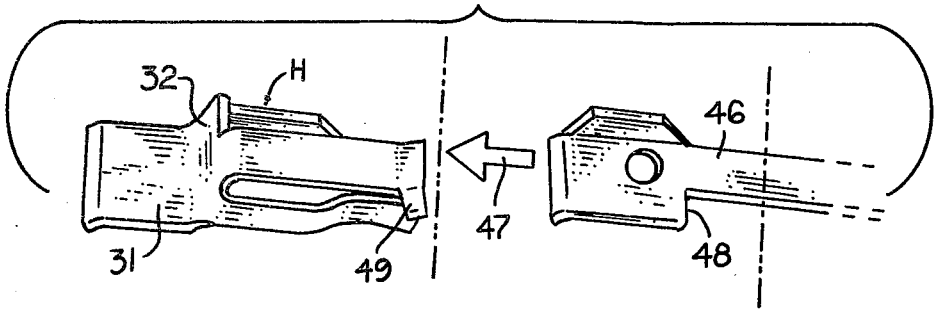
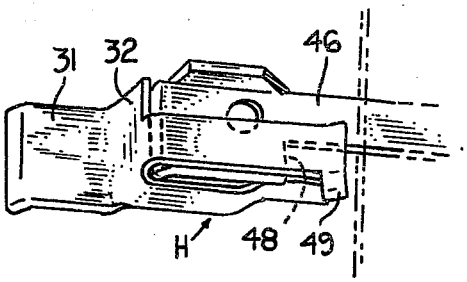
FIG-8-
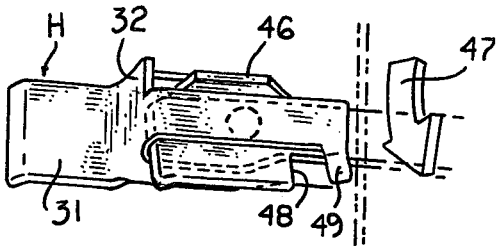
FIG-9-
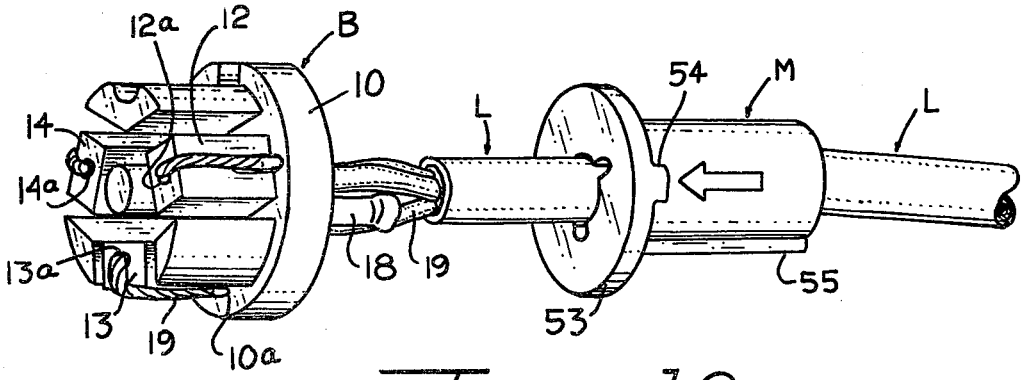
FIG-10-

CONVERTER PLUG WITH IMPROVED SELF-LOCKING TERMINALS TO STANDARD PLUG

CROSS REFERENCE TO RELATED APPLICATION

In my copending patent application on a Converter Plug, Ser. No. 937,470, filed Aug. 28, 1978, I disclose a converter plug that has two electrodes adapted to be inserted into a standard electric outlet box. The converter plug also has a "ground" terminal that may be moved into operative position or may be moved into an inoperative position. My present invention on the converter plug shows the "ground" wire and the other two electric wires being received in a cable. I do not use a retractable "ground" terminal in the present converter plug.

SUMMARY OF THE INVENTION

An object of my invention is to provide a converter plug that has a terminal carrier which receives the two wires and the "ground" wire of the cable and provides means for anchoring the bare metal strands of these wires and electrically connecting them to the two electrodes and "ground" terminal. A housing or main body receives the terminal carrier with its two electrodes and "ground" terminal and holds these in electrical contact with their associate metal strands of the two wires and the "ground" wire.

BRIEF DESCRIPTION OF THE DRAWINGS

FIG. 7 is an enlarged isometric view of the "ground" terminal in the converter plug and shows how the "ground" terminal of a standard plug is about to be connected to it.

FIG. 8 shows the initial connection between the two "ground" terminals of the converter plug and the standard plug.

FIG. 9 illustrates how the "ground" terminal of the standard plug interlocks with the "ground" terminal of the converter plug when the standard plug is rotated angularly with respect to the converter plug.

FIG. 10 is an isometric view of the terminal carrier and its associate part when a smaller diameter cable has its three wires connected to the carrier.

DESCRIPTION OF THE PREFERRED EMBODIMENTS

Figure 1:
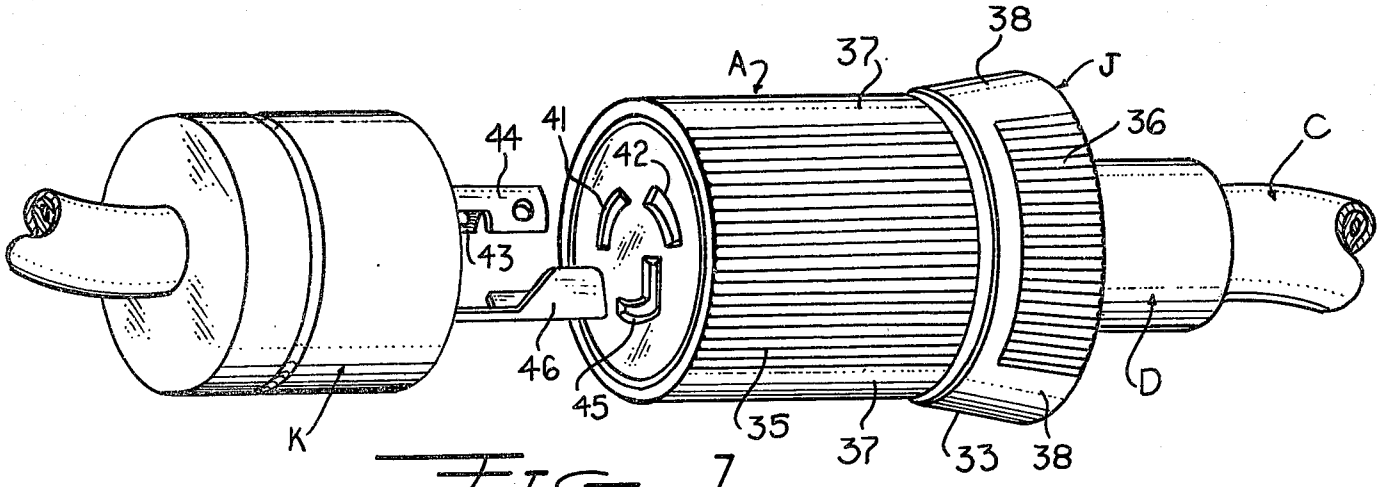
FIG. 1 is an isometric view of the converter plug and is shown as about to be electrically connected to a standard plug having two electrodes and a "ground" terminal.
Figure 2:
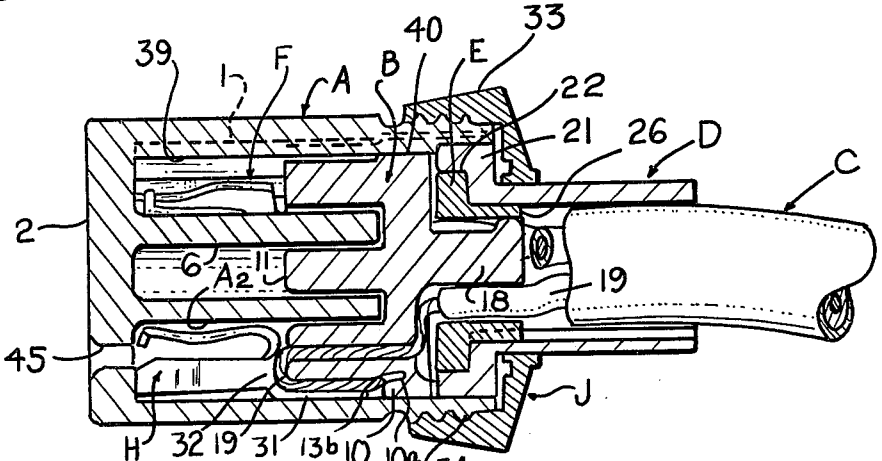
FIG. 2 is a longitudinal section through the converter plug.
Figures 3, 4, 5, 6:
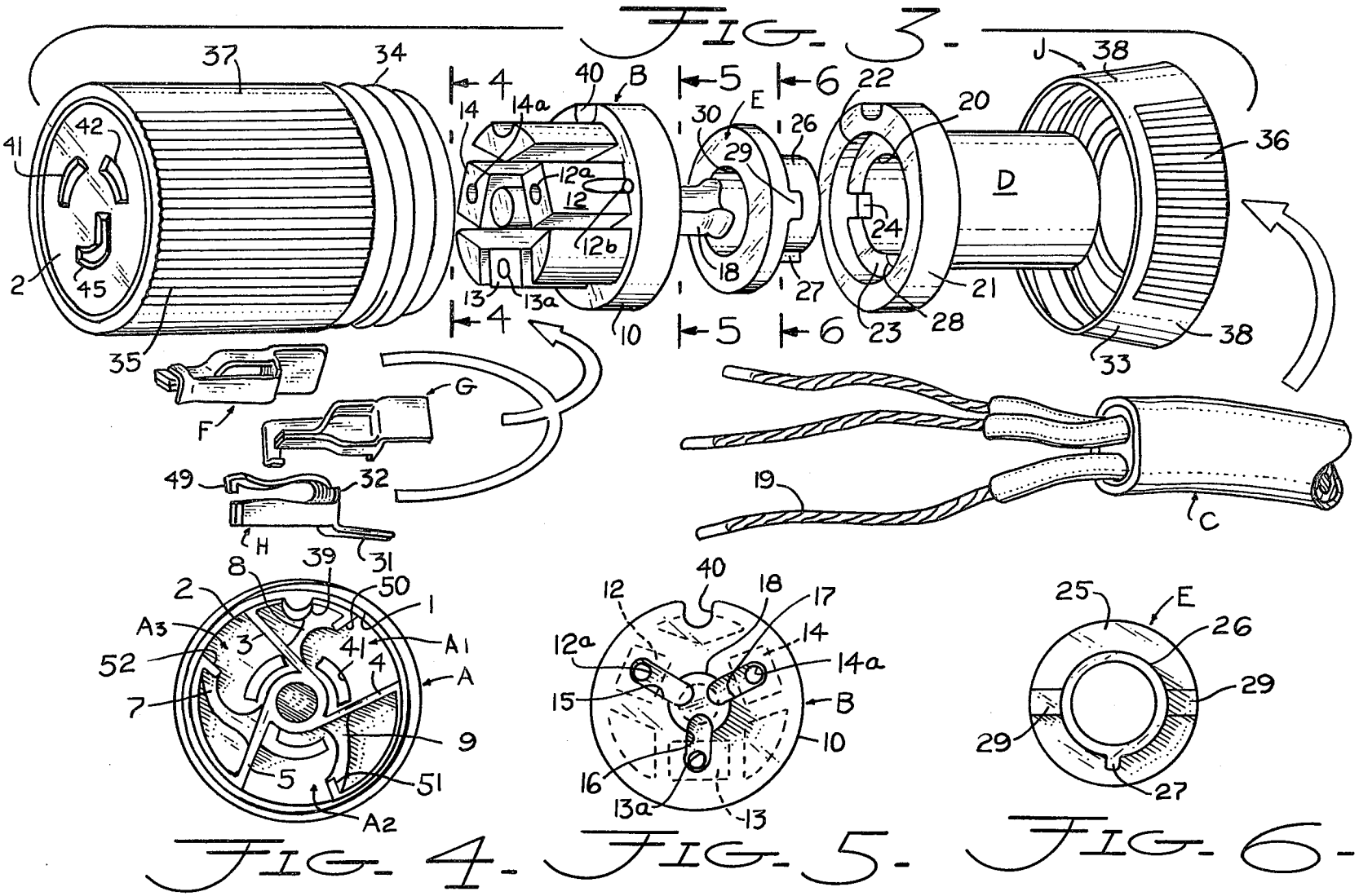
FIG. 3 is an exploded isometric view of all of the parts making up the converter plug.
FIG. 4 is an end view of the main body when looking in the direction of the arrows 4—4 of FIG. 3.
FIG. 5 is an end view of the terminal carrier when looking in the direction of the arrows 5—5 of FIG. 3.
FIG. 6 is an end view of the insert shown in FIG. 3 when looking in the direction of the arrows 6—6 in this Figure.

In carrying out my invention, I provide a main body A for the converter plug, see the exploded view of FIG. 3, as well as FIGS. 1 and 2. This main body is cylindrical in shape and it has a hollow cylindrical interior 1 and a closed end 2. The hollow interior of the main body has three compartments formed therein by three partitions, 3,4 and 5 that extend substantially in a radial direction from a central longitudinally extending portion that has an axially aligned center bore 6 therein, see FIG. 4. The closed end 2 of the main body has three arcuate-shaped ribs 7, 8 and 9 on its inner surface that cooperate respectively with the three partitions 3, 4 and 5, for holding the three electrodes in the compartments from angular displacement when the standard plug has its three electrodes inserted into the converter plug and the two plugs angularly rotated with respect to each other for interlocking the standard plug electrodes with the three electrodes in the converter plug. This feature will be more fully described hereinafter.

A terminal carrier B, is shown in isometric in FIG. 3 and an end view is shown in FIG. 5. The terminal carrier has a base 10 with an integral axially aligned cylindrical rod 11 projecting therefrom and adapted to be received in the bore 6 in the main body, see FIG. 2. The base 10 also has three integral projections 12, 13 and 14 which surround the central rod 11 and are spaced therefrom as shown in FIG. 3 and by dotted lines in FIG. 5. These three projections are angularly spaced from each other by 120° and each has a central wire receiving bore 12*a*, 13*a*, and 14*a*. The wire receiving bores extend through the carrier base 10 and radial grooves 15, 16 and 17 in the base, see FIG. 5 also receive the wires.

A finger gripping central handle 18 is integral with the base 10 of the terminal carrier and is axially aligned with the rod 11 and projects from the opposite face of the base from that of the rod, see FIGS. 3 and 5. This axial handle 18 has three longitudinally extending grooves in its periphery and these grooves extend to the radial grooves 15, 16 and 17 in the base 10 and receive the wires therefrom as will be described later. FIG. 3 shows the projection 12 with a groove 12*b* for receiving the bare metal strands of the end of the wire portion that extends from the bore 12*a* and FIG. 2 illustrates how the bare metal strands of a wire 19 extend from the bore 13*a* in the projection 13 and are bent back on themselves and are received in a groove 13*b* with the ends of the strands being soldered together and received in recess 10*a* in the base.

When a large diameter cable C, is connected to the converter plug, see FIGS. 1, 2 and 3, the cable is received in the bore 20 of a sleeve D. The sleeve has an annular rim 21 that in turn has an annular recess 22 therein. The annular shoulder 23 provided between the recess 22 and the bore 20 in the sleeve D, has notches 24 therein as clearly shown in FIG. 3. The annular recess 22 receives an insert E which is shown in FIGS. 3 and 6. This insert has an annular rim 25 that is received in the recess 22 and it has a cylindrical portion 26 received in the bore 20 in the sleeve D. The portion 26 has a longitudinally extending key 27, see FIG. 6, that is received in a keyway groove 28 in the inner cylindrical surface of the sleeve D. In addition, the rim 25 of the insert has diametrically opposed projections 29, see FIGS. 3 and 6, on its underside and these projections are received in the notches 24 in the sleeve D. The bore 30 in the insert E, receives the handle 18 of the terminal carrier B.

The three wires in the large diameter cable C have their bare wire strands anchored to the projections 12, 13 and 14 in the same manner as already described for the wire 19. The three compartments in the main body A receive two electrodes F and G, and a "ground" terminal H, see FIG. 3. In FIG. 4 the three compartments are designated at A1, A2 and A3. The electrode F, is received in the compartment A3 while the electrode G, is positioned in the compartment A1. The compartment A2 receives the "ground" terminal H, and it is shown in FIG. 2. The "ground" terminal has a tongue 31, as shown in FIG. 3, and this tongue is held in electrical contact with the bare wire strands of the wire 19 which extend along the outer wall of the projection 13 on the terminal contact with that portion of the bare wire strands 19 which extend from the bore 13*a* in the projection 13 to the outer edge of the projection. What I have described for the "ground" terminal H, holds true for the other two electrodes F and G, and therefore these need no further detailed description.

The sleeve D and insert E, as well as the terminal carrier B, are mounted in the main body A, and are held in place by an end cap J that has an internally threaded skirt 33 which is screwed onto the externally threaded portion 34 of the main body A, see FIGS. 1, 2 and 3. The outer surfaces of the main body A and end cap J, are provided with knurled areas 35 and 36, respectively, see FIGS. 1 and 3, and with smooth areas 37 and 38 on which printed matter may be displayed.

The terminal carrier B, is properly aligned in the interior of the main body A because the body has a longitudinally extending key 39 on its inner surface that is received in a keyway groove 40 in the periphery of the carrier, see FIGS. 2–5. The closed end 2 of the main body A has two arcuate slots 41 and 42 and these slots removably receive the two electrodes 43 and 44 of a standard electric plug K, shown in FIG. 1. The closed end 2 of the main body A also has an L-shaped slot 45 therein and the standard plug has a "ground" terminal 46 with an end portion that is L-shaped in cross section and this L-shaped portion is removably received in the L-shaped slot 45 so as to make an electrical connection with the "ground" terminal H, in the main body A.

In FIGS. 7, 8 and 9 there is illustrated on an enlarged scale how the "ground" terminal 46 of the standard electric plug K is moved into locking engagement with the "ground" terminal H, in the main body A. The arrow 47 in FIG. 7 indicates the line of movement of the "ground" terminal 46 as it is moved into electrical contact with the terminal H. FIG. 8 illustrates the completion of the coupling movement while FIG. 9 shows the "ground" terminal 46 being rotated angularly as indicated by the arrow 47 with respect to the "ground" terminal H for moving the shoulder 48 of the terminal 46 under a tongue 49 on the terminal H. This tongue 49 will prevent the accidental direct withdrawal of the standard plug K from the electrodes in the main body A. The standard plug K must be rotated in a reverse direction to the arrow 47 in FIG. 9 before the standard plug may be disconnected from the electrodes in the main body A.

It is important that the three electrodes in the main body A be not displaced laterally in the compartments A1, A2 and A3 in the main body when there is a relative rotative movement of the standard plug K with respect to the main body A when locking the two together or when unlocking one from the other. Reference to FIG. 2 will show how I accomplish this. The arcuate shaped rib 8 on the inner surface of the closed end 2 of the main body A cooperates with the radial partition 4 to hold the electrode G, in the compartment A1 from any lateral displacement in the compartment. Also, the compartment A1 has an inwardly extending rib 50 which cooperates with the arcuate rib 8 for holding the electrode G against lateral movement.

What I have just set forth in structure for preventing any lateral displacement of the electrode G, in the compartment A1, of the main body A will hold true for the "ground" terminal H, in the compartment A2 and the electrode F, in the compartment A3. The compartment A2 has the arcuate rib 9, see FIG. 4, and the inwardly extending rib 51. The compartment A3 has the arcuate rib 7 and the longitudinal and inwardly extending rib 52.

In FIG. 10 I show a slight modification of my invention where a smaller diameter cable L is used. Instead of using the insert E and mounting it in the sleeve D, I use a smaller diameter sleeve M that receives the cable and the sleeve has an annular flange 53 with a projection 54 on its undersurface. The sleeve M is received in the bore 20 of the larger diameter sleeve D, see FIG. 3, and the projection 54 is received in the notch 24. In addition the sleeve M has a longitudinally extending key 55 that is received in the keyway 28 of the sleeve D. The three wires in the smaller diameter cable L, are connected to the terminal carrier B, in exactly the same manner as already described for connecting the three wires in the large diameter cable C to the terminal carrier. The parts are then mounted within the main body A and are secured in place and are electrically connected to the electrodes F, G and H, by the connecting of the end cap J to the main body. No further detailed description need be given of the modified form shown in FIG. 10.

I claim:

1. A converter electric plug comprising:

(a) a main cylindrical body closed at one end an exteriorily threaded at the other end, the hollow interior of said body being divided into three compartments by substantially radially extending partitions;

(b) two electrodes positioned in two of said compartments, the closed end of said main body having arcuate slots therein to permit the entrance of electrodes of a standard plug to make electrical connection with said electrodes;

(c) a "ground" terminal positioned in the third compartment, the closed end of said body having an L-shaped slot therein to permit the entrance of a "ground" terminal of the standard plug to make electrical connection with said "ground" terminal in said compartment; and (d) the inner surface of the closed end of said body having an arcuate rib in each compartment extending inwardly and cooperating with an inwardly extending longitudinal rib in each compartment for contacting the sides of the two electrodes and "ground" terminal therein when the electrodes and terminals contact the closed end inner surface for holding these in contact with their adjacent radially extending partition to prevent any angular shifting of the two electrodes and "ground" terminal in the compartments when the standard plug has its prongs inserted into the compartments and is rotated with respect to the main body.

* * * * *